United States Patent [19]

Carter et al.

[11] Patent Number: 4,700,862

[45] Date of Patent: Oct. 20, 1987

[54] COLLAPSIBLE SIDEWALL STRUCTURE FOR STACKABLE BIN

[75] Inventors: Alan T. Carter, Elkhart, Ind.; Lloyd W. Carter; Richard Earl, both of Sturgis, Mich.

[73] Assignee: Carter Associates, Sturgis, Mich.

[21] Appl. No.: 894,603

[22] Filed: Aug. 8, 1986

[51] Int. Cl.[4] ..... B65D 19/00

[52] U.S. Cl. ..... 220/6; 220/443; 229/41 R

[58] Field of Search ..... 220/6, 441, 443, 453, 220/461; 229/41 R; 217/12 R, 43 R, 16, 48

[56] References Cited

U.S. PATENT DOCUMENTS

| | | | |
|---|---|---|---|
| 1,384,065 | 7/1921 | Hirschwitz | 229/41 R |
| 3,135,452 | 6/1964 | Brundage | 220/443 |
| 3,344,973 | 10/1967 | Studen | 220/453 X |
| 3,910,482 | 10/1975 | Bamburg et al. | 220/443 X |
| 4,643,314 | 2/1987 | Kidd | 220/6 X |

*Primary Examiner*—Steven M. Pollard

*Attorney, Agent, or Firm*—Flynn, Thiel, Boutell & Tanis

[57] ABSTRACT

A stackable storage bin having a collapsible six-fold sidewall structure which, when opened, defines a vertically-oriented rectangular tube which removably cooperates with upper and lower pallets for defining a closed storage compartment. The sidewall arrangement has the end and side walls constructed of at least a three-ply laminate defined by inner and outer layers fixedly and coextensively secured to opposite sides of an intermediate layer. The inner and outer layers each include inner and outer facing sheets joined by transversely extending ribs therebetween. These inner and outer layers are entirely of plastic and are preferably formed either as a profile extrusion or as a double-faced corrugated sheet. The intermediate layer is of a light-weight rigid foam.

13 Claims, 10 Drawing Figures

COLLAPSIBLE SIDEWALL STRUCTURE FOR STACKABLE BIN

FIELD OF THE INVENTION

This invention relates to an improved collapsible sidewall structure which removably cooperates with upper and lower supports, such as pallets, to define a stackable storage bin.

BACKGROUND OF THE INVENTION

Many industries, and more particularly the automotive industry, utilize stackable bins employing collapsible sidewalls for transporting components or articles, particularly when such transporting requires shipment by carrier such as a truck from a first location to a distant second location. Stackable bins of the type commonly utilized employ upper and lower supports or pallets which are conventionally vacuumed form of heavy plastic material, with a tube-like sidewall structure being removably positioned between the upper and lower pallets to define an enclosed compartment for the goods being transported. A plurality of such bins are then typically vertically stacked on top of one another within the truck or other transport vehicle. Due to the heavy loads which are transported within these storage bins, and the fact that several such bins are vertically stacked on top of one another, hence requires that the tube-like sidewall structure be capable of withstanding significant loading, particularly vertical compressive loading.

In addition to the loading requirements, these bins must also be readily folded and compactly stored when empty so as to facilitate return shipment while occupying only minimal space. For this purpose, one commonly utilized sidewall structure employs sheet-like parallel side walls hingedly joined at the ends thereof to sheet-like end walls. The end walls have a central vertical hinge so that each end wall functions as a bi-fold and can be folded inwardly between the sidewalls to permit substantially flat collapsing and storing of the sidewall structure. This type of collapsible sidewall structure is commonly referred to as a "six-fold".

This six-fold sidewall structure is conventionally formed of a wall structure created by laminating several layers of corrugated paper board together. That is, the side and end walls typically are formed by three corrugated layers of paper board adhesively bonded together so that the resulting wall structure is of a multi-ply construction so as to provide increased strength and rigidity. This multi-ply construction also forms the corner hinges and the center end wall hinges, which hinges typically are defined by score lines. While six-folds constructed of laminated paper board are well known and widely utilized, and are advantageous in view of their minimal cost, nevertheless they also possess recognized disadvantages. A primary disadvantage of the six-fold employing laminated corrugated paper board is its extremely short life. Users of this type six-fold have discovered that such a six-fold can only be used a small number of times, typically three to five loading-and-return cycles, before the six-fold experiences sufficient deformation and damage as to require its disposal. This type of six-fold is also of limited vertical stacking strength and, when dealing with extremely heavy loads, is often unsuitable since the thickness of the wall structure cannot be increased in view of the limitations imposed by the pallets. Further, this type six-fold is subject to damage due to its exposure to moisture, grease and the like.

In an attempt to provide an improved six-fold sidewall structure, one modification has been proposed wherein the walls are formed by bonding together several layers of corrugated plastic, with the corner hinges between the end and sidewalls being created by a vertically-extending mill cut. This sidewall structure as formed solely from several corrugated plastic layers, however, has proven to possess several disadvantages. To begin with, this sidewall arrangement is much heavier than a paper six-fold and, since weight is of importance when shipping product, it is hence desirable to maintain the weight of the bin at a minimum. Another disadvantage is that this plastic six-fold does not possess adequate stacking strength since any distortion or misalignment results in the sidewall arrangement being loaded in a manner which is less than optimum relative to the corrugated structure of the sidewalls, and hence can cause collapsing or failure under load. This plastic six-fold is also much more costly to manufacture than a paper six-fold. The manner in which the plastic six-fold is provided with a milled slot defining the corner hinge is also believed to create a significant weakness. Hence, this plastic six-fold has proven to possess little, if any, advantage over the paper six-fold and thus has had only limited commercial acceptance.

Accordingly, it is an object of this invention to provide an improved collapsible six-fold sidewall structure for a stackable bin, which sidewall structure possesses structural and functional features which significantly overcome many of the aforementioned disadvantages.

More specifically, this invention relates to an improved collapsible sidewall arrangement of the six-fold type for use in a collapsible bin, as aforesaid, which sidewall arrangement is capable of providing increased stacking strength and hence increased vertical loading capability, is capable of providing greater strength for resisting distortion or deflection of the sidewalls due to distortion caused by loading either externally or internally, is of relatively light weight so as to not significantly affect the overall weight or payload which can be carried by the bin, is resistant to moisture and other liquids, can be successfully utilized for a large number of transporting load cycles (such as up to 100 loading cycles) prior to requiring replacement, and is more economical to purchase and utilize when evaluated on the basis of cost versus life.

In the improved six-fold sidewall structure of this invention, the side and end walls are each of a multi-ply laminate, preferably a three-ply laminate. The laminate includes inner and outer layers which coextensively overlie and are adhesively secured or bonded to opposite sides of an intermediate or middle layer. This middle layer comprises a thin sheet of rigid plastic foam such as expanded polystyrene which is of rather low density so as to provide the side and end walls with extremely high compressive strength for purposes of vertical stacking. The inner and outer layers are generally substantially identical and each is formed by a plastic layer having parallel inner and outer facing sheets rigidly joined together by a plurality of ribs which define therebetween a plurality of parallel channels which run between the facing sheets. These plastic layers are preferably formed from plastic such as polyethylene or polypropylene, and may be an extruded profile or laminated corrugated construction. These plastic layers, by being bonded to opposite sides of the expanded foam layer, cooperate therewith to provide the walls of the sidewall structure with the durability required to withstand the side loads which are applied to the sidewall structure and provide significantly greater side distortion strength.

In addition to the laminated construction associated with the six-fold sidewall arrangement as explained above, this sidewall arrangement also utilizes one of the plastic layers, generally the outer layer, to function as a hinge both for the bi-fold endwalls and for the corners.

Other objects and purposes of the structure according to the present invention will be apparent to persons familiar with structures of this general type upon reading the following specification and inspecting the accompanying drawings.

Figure 1:
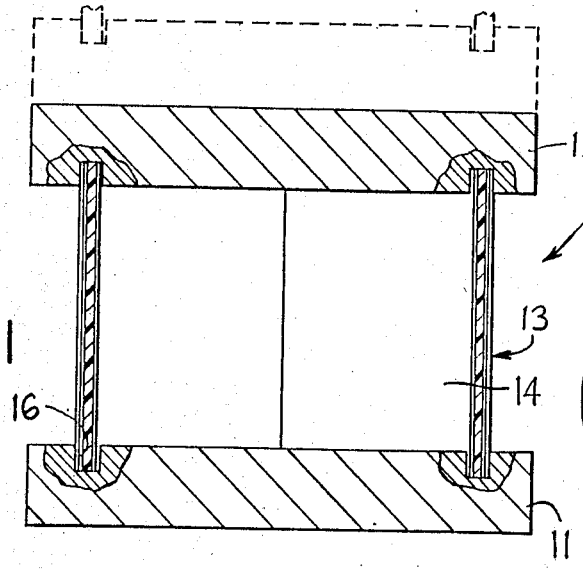
FIG. 1 is an elevational view, partially in cross-section, diagrammatically illustrating a conventional collapsible bin employing a six-fold sidewall arrangement in cooperative relationship with upper and lower pallets.

Certain terminology will be used in the following description for convenience and reference only, and will not be limiting. For example, the words "upwardly", "downwardly", "rightwardly", and "leftwardly" will refer to directions in the drawings to which reference is made. The words "inwardly", "outwardly" will refer to directions toward and away from, respectively, the geometric center of the structure and designated parts thereof. Said terminology will include the words specifically mentioned, derivatives thereof, and words of similar import.

DETAILED DESCRIPTION

Referring to FIG. 1, there is illustrated a collapsible bin 10 which is diagrammatically typical of many such bins conventionally in use. This bin 10 includes bottom and top pallets 11 and 12, respectively. These pallets 11 and 12 are typically identical and often are vacuum form of a plastics material. The pallets are designed to cooperate with a collapsible sidewall structure 13, the latter when open having a tube-like configuration defining a vertical opening therethrough, the ends of this opening being closed by the pallets 11 and 12. This collapsible sidewall structure 13, when in an open condition, cooperates with the pallets to define an interior storage compartment 14. The pallets 11 and 12 typically have structure which cooperates to define an opening or recess 16 which in general is of a somewhat rectangular profile around the outer edge portion of the pallet so as to sidewardly confine the edge of the sidewall structure 13 therein so as to maintain the latter in its open or noncollapsed position.

The bin, when assembled as described above, is often times secured by means of bands wrapped around the upper and lower pallets so as to confine them in engagement with the opposite ends of the sidewall structure 13. Further, for transporting, a plurality of such bins are disposed in vertically stacked relationship, as diagrammatically indicated by dotted lines in FIG. 1, and hence the sidewall arrangement 13 thus must accommodate the vertical compression loads which are transmitted therethrough due to the bins which are stacked thereabove.

Figure 2:
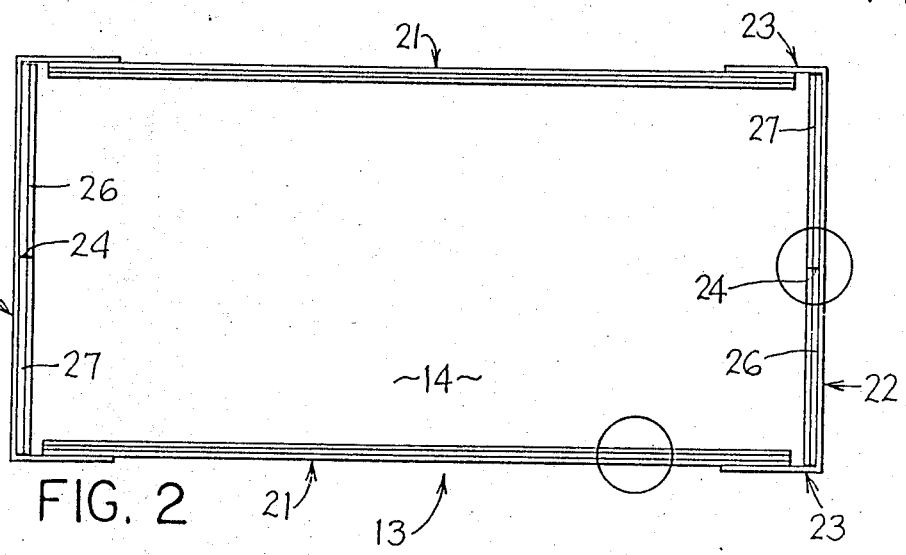
FIG. 2 is a top view of the six-fold of this invention in an open (i.e. use) condition.

The collapsible sidewall structure 13, as illustrated by FIG. 2, includes substantially parallel side walls 21 which are joined together by end walls 22, the latter being substantially parallel and extending substantially perpendicularly between the side walls when the sidewall structure is in its open vertically-oriented condition as illustrated by FIGS. 1 and 2. The adjacent edges of the side and end walls 21 and 22 are joined together by a hinge type corner structure 23. A further hinge 24 extends vertically of each end wall 22 substantially midway between the sidewalls 21. This hinge 24 causes the end wall 22 to be of a bi-fold construction having a pair of wall portions 26 and 27 which project outwardly from opposite sides of the hinge 24. The corner hinge structures 23 and center hinges 24 permit the end walls to fold inwardly so that the wall portions 26 and 27 directly overlie one another, and hence enable the sidewall arrangement 13 to be stored in a collapsed position as diagrammatically illustrated by FIG. 8.

The general structural and functional arrangements of the bin 10 and sidewall structure 13 as described above are conventional and well known.

Figure 3:
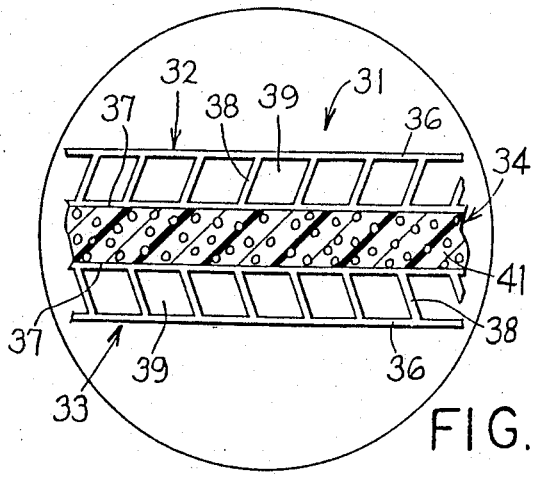
FIG. 3 is an enlarged sectional view showing the laminate which defines the side and end walls.
Figure 5:
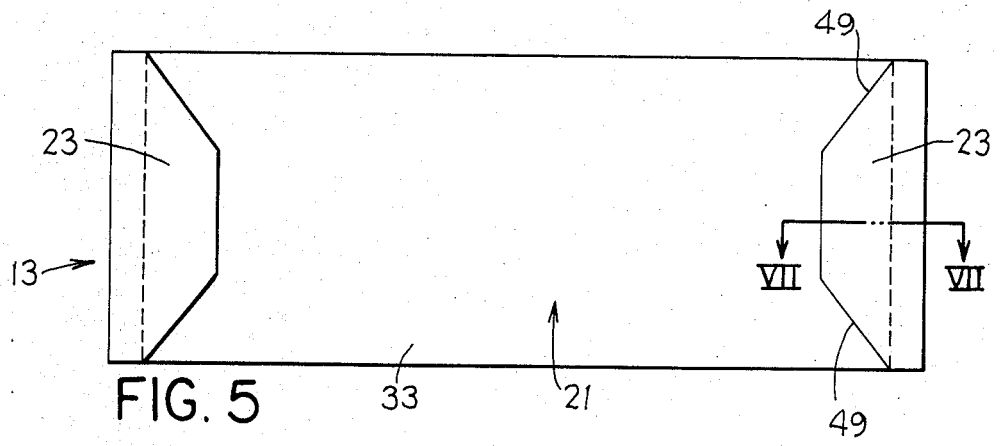
FIG. 5 is a side elevational view of the sidewall arrangement shown in FIG. 2.
Figure 6:
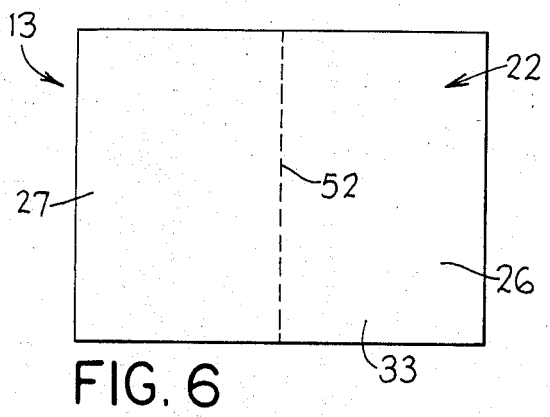
FIG. 6 is an end elevational view of FIG. 5.

According to the present invention, the walls 21 and 22 each have a laminated wall structure 31 (FIG. 3) defined by inner and outer layers 32 and 33, respectively, which are adhesively secured or bonded to opposite sides of an intermediate or middle layer 34. This structure or laminate 31 is hence of a multi-ply construction, with each ply extending over substantially the full planar extent of the respective wall.

The inner wall 32 includes substantially parallel facing sheets 36 and 37 which are spaced apart and are rigidly, here integrally, joined together by a plurality of ribs 38 which extend transversely therebetween. These ribs 38 extend in generally parallel relationship throughout the width or lengthwise directions of the respective wall, with the adjacent ribs 38 cooperating with the facing sheets 36, 37 so as to define a plurality of parallel channels 39 which extend interiorly of the layer along the one direction. The inner layer 32, when constructed as described above, is preferably formed by being extruded in one piece of a plastic material, such extrusion conventionally being referred to as a "profile" extrusion. This inner layer 32 is constructed entirely of plastic material, more specifically a non-foamed plastic material. Polyethylene or polypropylene are particularly suitable for this inner layer 32.

The outer layer 33 is preferably constructed identically to the inner layer 32 and hence possess the same basic structure, and is of the same plastic material.

The ribs 38 and channels 39 associated with the layers 32 and 33 preferably extend in the widthwise or height direction of the side and end walls 21 and 22, and hence the ribs 38 and channels 39 project in a generally vertical direction when the sidewall structure 13 is in its opened use position.

As to the third or intermediate layer 34, it comprises a sheet of rigid foam 41 which extends substantially coextensively with and between the inner and outer layers 32 and 33. This foam layer 41 has the opposite side surfaces thereof bonded or adhesively secured to the adjacent side faces of the respective layers 32 and 33. In a preferred embodiment, the opposed and overlying faces of the foam sheet 41 and layers 32, 33 are preferably bonded together so as to achieve an adhesive-free securement, these sheets being bonded together by use of a conventional solvent which effects dissolving of the surfaces of the sheets to hence effect a chemical bonding of the layers together. However, an adhesive could also be applied to the opposed faces of these layers to rigidly secure them together, although bonding is preferred to adhesive securement since it effectively results in the three layers of the laminate effectively functioning as a single integral layer so as to optimize the strength and rigidity thereof.

The foam sheet 41 is preferably of expanded polystyrene (i.e., styrofoam), although rigid polyurethane foam could also be utilized. The foam defining this rigid sheet 41 preferably has a density in the range of from about one pound to about four pounds per cubic foot.

In typical bins, the pallets are normally designed to accommodate a sidewall arrangement 13 having a wall thickness of either about $\frac{3}{8}$ inch or $\frac{3}{4}$ inch. When the laminate 31 is designed as a $\frac{3}{8}$ inch thickness, then each of the layers 32–34 is generally about $\frac{1}{8}$ inch thick, and the foam sheet 41 in particular has a minimum thickness of at least about $\frac{1}{8}$ inch. Further, in all of the laminates 31 irrespective of overall thickness, the foam sheet 41 preferably has a thickness which is no less than the thickness of either layer 32 or 33.

Figure 7:
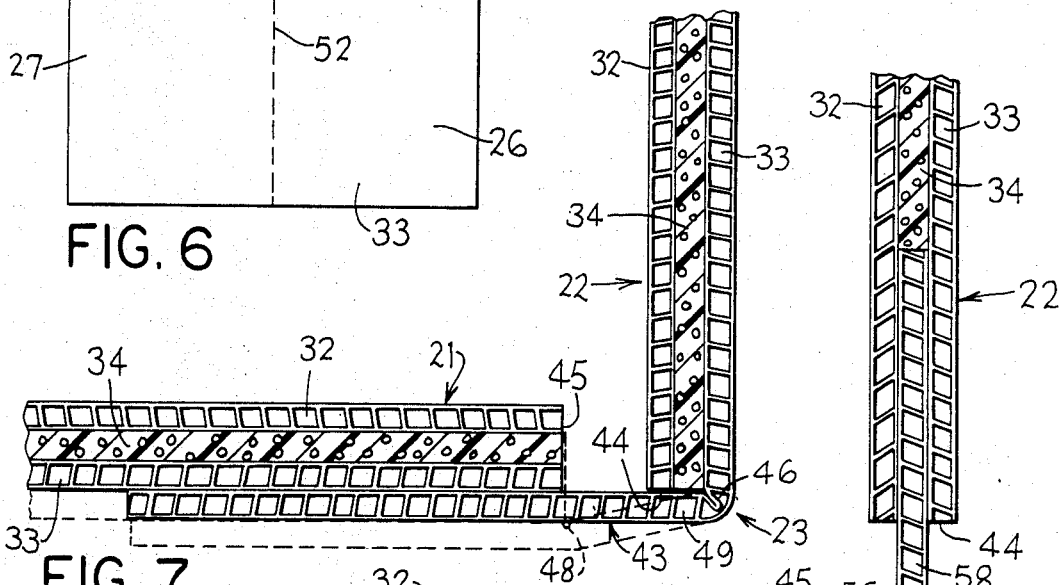
FIG. 7 is an enlarged, fragmentary sectional view taken substantially along line VII—VII in FIG. 6.

Considering now the hinged corner structure 23, a preferred embodiment of which is illustrated by FIG. 7, this hinged corner structure is defined by a hinge flap 43 which is fixedly associated with the endwall 22 and projects outwardly beyond the vertical free edge 44 thereof for connection to the adjacent sidewall 21. This hinge flap 43, in the preferred embodiment shown by FIG. 7, is integral with and constitutes an extension of the outer layer 33 with the hinge flap 43 being effectively folded or hinged at 46, the latter extending vertically throughout the complete height of the hinge flap and being disposed closely adjacent the edge 44. This fold or hinge line 46 results in the hinge flap 43 projecting inwardly across the end edge 44 and then extending coextensively over a portion of the outer surface of the sidewall 21. More specifically, this hinge flap 43 directly overlaps the outer side surface (namely the outer facing sheet 36 of outer layer 33) of the sidewall 21 and is preferably bonded to (or alternately, adhesively secured to) the outer or exterior surface of the sidewall 21. The hinge flap 43 is, adjacent the upper and lower ends thereof where it overlaps the sidewall 21, provided with recesses or relieved cutouts 49 so as to not interfere with the fit of the sidewall structure into the recesses formed in the upper and lower pallets. The side wall 21 and its securement to the hinge flap 43 is such that the vertical free edge 45 of sidewall 21 is spaced from the end wall 22, and the hinge flap 43 thus defines a web part 49 which extends between the sidewall 21 and end wall 22 but which does not directly overlap the side surfaces of these walls. This intermediate web part 49 is dimensioned so as to have a length which approximately equals or slightly exceeds the combined thickness of walls 21 and 22 so as to permit the sidewall structure 13 to be collapsed into the position illustrated by FIG. 8.

During handling or usage of the sidewall arrangement 13, it has been observed that the hinge flap 43 will not always necessarily fold about a single hinge line, such as the line 46, but in some instances a secondary fold or hinge line 48 will be created directly adjacent the free edge 45 of sidewall 21, in which case the side wall will be positioned slightly outwardly substantially as indicated by dotted lines in FIG. 7.

Since the hinge flap 43 is identical to and in actuality constitutes an extension of the outer layer 33, the hinging action which creates the hinge or fold line 46 effectively causes a collapsing of the inner facing sheet 37 due to the presence of the channels 39. This hinge or fold line 46 can hence effectively occur at any point along the web part 48. This hinge or fold line 46 effectively extends directly along one of the vertically-oriented channels 39.

Figure 4:
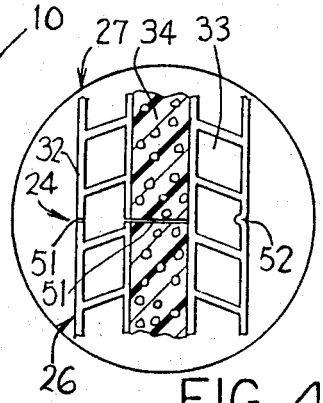
FIG. 4 is an enlarged sectional view which shows the central hinge associated with the bi-fold end wall.

As to the central vertical hinge 24 associated with the end wall 22, this hinge 24 is illustrated in FIG. 4 and is formed by creating a vertically extending slit or slot 51 which extends throughout the complete height of the end wall 22. This slit 51, however, extends through the complete thickness of only the inner layer 32 and the intermediate layer 34, and does not penetrate the outer layer 33. Rather, the latter integrally holds the wall portions 26 and 27 together and thus defines the hinge therebetween. This outer layer 33 can be effectively vertically hinged about the closed inner end of the slit 51, such as due to a collapsing of the outer facing sheet 36 along one of the channels 39 so as to hence define a vertical fold or hinge line along the closed inner end of the slit 51. If necessary or desired, the exterior face of the outer layer 33 can be provided with a vertical scoring line or depression 52 extending vertically across the exterior face in alignment with the slit 51 so as to more clearly define the hinge between the wall portions 26 and 27. This outer layer 33 hence in effect defines a "living hinge" for securing the wall portions 26 and 27 together.

The use of the hinge arrangement 23 of FIG. 7 is desirable since this enables each side wall 21 and end wall 22 to be formed as an integral one-piece unit employing a laminate 31 created by the three layers 32–34, each being of a discrete plate-like shape and size. Further, since the hinge flaps 43 are integral with and project outwardly from opposite ends of the outer layer 33 defining the end walls 22, this hence permits all of the walls 21 and 22 and the interconnecting hinge structures to be formed utilizing discreet plate-like members for defining the layers of the different walls. Further, each wall can also use continuous sheet-like members for defining each layer, and each wall is thus free of vertically extending seams in as much as the layers can be continuous throughout the critical wall areas.

Figure 9:
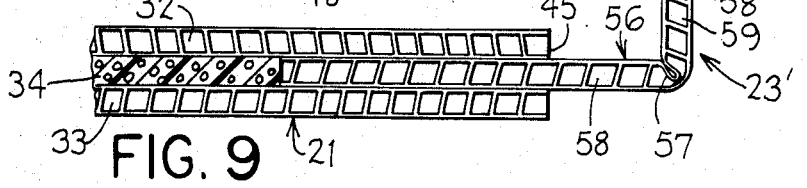
FIG. 9 is a view similar to FIG. 7 but illustrating a modified corner hinge.

FIG. 9 illustrates a modified corner hinge structure 23' which can be substituted for the corner structure 23 of FIG. 7 if desired. In the modification of FIG. 9, the corner hinge structure 23' is formed by a hinge plate 56 which is initially formed as a separate sheetlike member. This hinge plate 56 is a plastic layer which is structurally identical to the plastic layers 32 and 33. Hinge plate 56 is provided with a vertical fold of hinge line 57 extending throughout the height thereof at a location disposed intermediate its ends so as to define a pair of hinge flaps 58 which project outwardly from opposite sides of the fold 57. Each of these hinge flaps 58 projects into and is sandwiched between the inner and outer layers 32 and 33 of the respective walls 21 and 22. For this purpose, the hinge plate 56 has a thickness substantially corresponding to that of the foam sheets 34, and this latter sheet 34 is of shorter horizontal extent so that the free edge thereof is spaced inwardly from the free edges of the layers 32 and 33, thereby permitting the hinge flap 58 to occupy the space which is free of the foam sheet 34. This hinge flap 58 has the opposite side surfaces thereof preferably bonded (or alternately adhesively secured) to the opposed inner side surfaces of the plastic layers 32 and 33. The hinge flaps 58 preferably project outwardly a limited extent beyond the free edge of the respective walls 21 or 22 so as to provide an intermediate web portion 59 (the latter containing therein the hinge or fold line 57) which is free of the walls 21 and 22 and permits the overall sidewall structure to be moved into the collapsed position illustrated by FIG. 8.

While the inner and outer layers 32 and 33 have the ribs 38 and channels 39 running vertically in the preferred embodiment, it will be appreciated that one of these layers could be disposed so that the ribs and channels run horizontally, so long as at least one of the layers still has the ribs and channels running vertically. However, the vertical orientation with respect to both layers is preferred.

Figure 10:
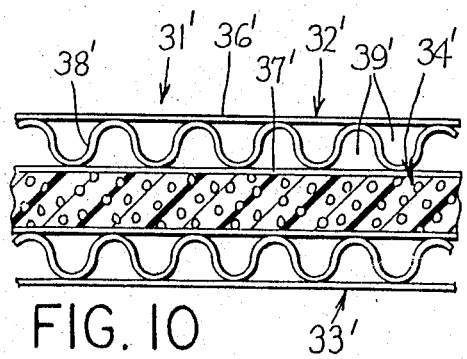
FIG. 10 is a view similar to FIG. 3 but illustrating a modified laminate for defining the side and end walls.

The layers 32 and 33 can also be formed of a corrugated construction, rather than a profile extrusion. In this regard, reference is made to FIG. 10 which identically corresponds to FIG. 3 except that the profile extrusions 32 and 33 have been replaced by corrugated layers. More specifically, in this variation, the laminate 31' defining both the side and end walls again has substantially identical inner and outer layers 32' and 33' respectively which are either bonded or adhesively secured to opposite faces of the intermediate layer 34', the latter again comprising the rigid plastic foam sheet 41. Each of these layers 32' and 33' is entirely of plastic and is formed by parallel facing sheet 36' and 37' which are spaced apart and joined together by ribs 38' which extend transversely between the facing sheets and are rigidly secured thereto, as by bonding or adhesive securement. The ribs 38' in this embodiment are formed by a continuous sheet which is of a corrugated or wave-like form whereby there is again defined closed channels 39' which are defined between the ribs. The ribs 38' and channels 39' again preferably extend in the widthwise, that is vertical, direction of the respective wall. The corrugated plastic layers 36' and 37' otherwise structurally and functionally cooperate with the laminate 31' and the overall sidewall structure 13 in the same manner as described above relative to use of the profile extrusion. Further, these corrugated layers 32' and 33' additionally permit forming of a fold or hinge line in the same manner as when using the profile extrusions, so that further description thereof is believed unnecessary.

Figure 8:
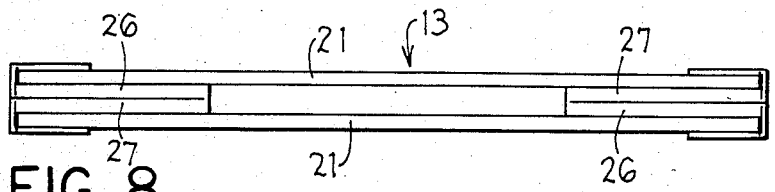
FIG. 8 is a view which diagrammatically illustrates the sidewall arrangement in its collapsed or storage position.

The use and operation of the sidewall structure 13 of this invention, and in particular its use in association with the structure of the bin 10, is believed readily apparent from the description set forth above, particularly when taken in conjunction with FIGS. 1, 2 and 8, so that further detailed description of the use of this structure is believed unnecessary.

Although a particular preferred embodiment of the invention has been disclosed in detail for illustrative purposes, it will be recognized that variation or modifications of the disclosed apparatus, including the rearrangement of parts, lie within the scope of the present invention.

In the sidewalls structure 13' any of the end or sidewalls can be provided with a removeable or tear-away access panel so as to provide an access opening to allow double stacking of bins along an assembly line. This access panel can be formed by either cuts or score lines, and the panel can be replaceable such as by being taped in position. The panel and the access opening will be defined wholly within the borders of the respective end or sidewall.

The embodiment of the invention in which an exclusive property or privilege is claimed are defined as follows:

1. In a collapsible storage bin having a collapsible six-fold sidewall structure which is horizontally of generally rectangular shape and defines a vertically extending opening therethrough, and upper and lower pallet-like supports removably engaged with the respective upper and lower edges of said sidewall structure for closing off said sidewall structure and defining a storage compartment therein, said sidewall structure including a pair of substantially parallel sheet-like side walls joined together by a pair of sheet-like end walls, the end and side walls having adjacent vertical edges joined together by a corner fold structure which permits relative horizontal swinging movement between the adjacent end and side walls, and each said end wall having a center fold structure extending vertically thereacross substantially midway between the vertical end edges thereof for dividing the end wall into two plate-like wall portions which are horizontally relatively swingably movable about said center fold structure, the improvement comprising:

each said side and end wall being constructed as a multi-ply laminate having substantially coextensive inner and outer layers fixedly secured to and substantially coextensively overlying opposite side faces of an intermediate layer;

each said inner and outer layer being constructed of plastic and having substantially parallel inner and outer plastic facing sheets joined together by a plurality of substantially parallel plastic ribs which extend transversely between and are rigidly joined to said facing sheets, said ribs and sheets cooperating to define therebetween a plurality of elongated and substantially parallel channels which are enclosed between said facing sheets, the ribs and channels of at least one of said inner and outer layers being elongated substantially vertically; and said intermediate layer being constructed as a sheet of light-weight rigid plastic foam.

2. The bin according to claim 1, wherein the foam sheet has a thickness which is at least about as thick as each of said inner and outer layers.

3. The bin according to claim 2, wherein said foam sheet is of polystyrene having a density in the range of about one pound per cubic foot to about four pounds per cubic foot, and wherein each of said inner and outer layers is constructed entirely of polyethylene or polypropylene.

4. A bin according to claim 3, wherein the ribs and channels associated with each of said inner and outer layers extend substantially vertically.

5. A bin according to claim 1, wherein said foam sheet has a minimum thickness of at least about ⅛ inch.

6. A bin according to claim 1, wherein said center fold structure as associated with each said end wall is defined by a slit which extends vertically between the upper and lower edges of said end wall and which projects inwardly entirely through the thickness of said inner layer and said intermediate layer but not through said outer layer so that the latter defines a living hinge adjacent the closed end of said slit so that the pair of wall portions as associated with the respective end wall can be relatively folded inwardly so as to directly overlie one another when the sidewall structure is in a collapsed condition.

7. A bin according to claim 6, wherein said corner fold structure is of a single ply and is defined by said flap, said flap having a web part which is of selected horizontal extent as it extends between the adjacent end edges of said side and end walls, said selected horizontal extent being at least equal to the combined thickness of the inner and intermediate layers of the adjacent side and end walls to permit the latter to directly fold one over the other when the sidewall structure is in the collapsed condition.

8. A bin according to claim 1, wherein said corner fold structure includes a flap which is integral with the outer layer of one of said end and side walls, said flap projecting outwardly beyond the vertical end edge of said one end and side walls and projecting toward and being fixedly secured to the other of said end and side walls so that said flap functions as a corner hinge to permit the sidewall structure to be folded into a collapsed condition.

9. A bin according to claim 8 wherein said flap has a free edge part which externally overlaps and is fixedly secured to the outer layer of said other wall.

10. A bin according to claim 1, wherein said corner fold structure is formed by a sheet-like corner flap which is constructed entirely of plastics and has a construction substantially corresponding to that of said inner and outer layers, said sheet-like corner flap including a pair of substantially planar hinge parts joined together about a vertically-extending fold line which functions as a hinge, one of said hinge parts being fixedly secured to one side wall adjacent an end edge thereof, and the other hinge part being fixedly secured to one end wall in the vicinity of the adjacent end edge thereof.

11. A bin according to claim 10, wherein each of said end and sidewalls in the vicinity of said end edge has its respective hinge part sandwiched directly between and fixedly secured to the inner and outer layers.

12. A bin according to claim 1, wherein each of said inner and outer layers is formed as an extruded profile.

13. A bin according to claim 1, wherein each of said inner and outer layers is of a double-faced corrugated construction.

* * * * *

UNITED STATES PATENT AND TRADEMARK OFFICE

CERTIFICATE OF CORRECTION

PATENT NO. : 4 700 862

DATED : October 20, 1987

INVENTOR(S) : Alan T. CARTER et al

It is certified that error appears in the above-identified patent and that said Letters Patent is hereby corrected as shown below:

Column 9, line 15; change "claim 6" to ---claim 8---.

Column 10, line 21; change "sidewalls" to ---side walls---.

Signed and Sealed this

Seventh Day of June, 1988

*Attest:*

DONALD J. QUIGG

*Attesting Officer*

*Commissioner of Patents and Trademarks*